US005540372A

United States Patent [19]

Buglioni

[11] Patent Number: 5,540,372

[45] Date of Patent: Jul. 30, 1996

[54] CAM ACTIVATED HYDRAULIC DRIVE WITH HYDRO-PNEUMATIC ACCUMULATOR

[75] Inventor: Gianluigi Buglioni, Macerata, Italy

[73] Assignee: Redaelli Tecna Meccanica S.p.A., Milano, Italy

[21] Appl. No.: 144,470

[22] Filed: Nov. 2, 1993

[30] Foreign Application Priority Data

Nov. 4, 1992 [IT] Italy ..... MI92A2527

[51] Int. Cl.[6] ..... B65H 51/18

[52] U.S. Cl. ..... 226/158; 226/165

[58] Field of Search ..... 226/158, 165, 226/97, 112, 115, 117; 60/581, 594, 417; 92/134, 110, 117 A

[56] References Cited

U.S. PATENT DOCUMENTS

| | | | |
|---|---|---|---|
| 2,862,360 | 12/1958 | Audemar | 60/417 |
| 2,984,980 | 5/1961 | Rowles et al. | 60/417 |
| 3,570,244 | 3/1971 | Strobel et al. | 60/417 |
| 3,583,268 | 6/1971 | Scribner | 226/112 X |
| 3,844,152 | 10/1974 | Paytavin | 226/112 X |
| 4,003,278 | 1/1977 | Shields | 226/162 X |
| 4,328,670 | 5/1982 | McLean | 60/594 X |
| 4,829,880 | 5/1989 | Lieberman | 92/117 AX |
| 5,014,602 | 5/1991 | Iwata | 92/117 A |
| 5,336,067 | 8/1994 | Lim | 418/49 |
| 5,337,565 | 8/1994 | Meixner | 60/594 |

FOREIGN PATENT DOCUMENTS

| | | | |
|---|---|---|---|
| 0255740 | 2/1988 | European Pat. Off. . | |
| 2510914 | 6/1982 | France . | |
| 1027166 | 4/1958 | Germany . | |
| 1061049 | 7/1959 | Germany | 226/158 |
| 419797 | of 1947 | Italy | 60/581 |
| 135623 | 7/1961 | Netherlands . | |

OTHER PUBLICATIONS

IBM Technical Disclosure, Hydraulic System By K. Lindner, Nov. 1963.

*Primary Examiner*—John P. Darling

*Attorney, Agent, or Firm*—Watson Cole Stevens Davis P.L.L.C.

[57] ABSTRACT

A drive unit (10) comprising a cam (11) acting on at least one hydraulic drive plunger (16, 17) hydraulically connected to at least one thrust plunger (18, 19) for a traction carriage (20, 21) to be moved along its stroke. The at least one thrust plunger (18, 19) is a double-acting plunger one side of which is connected to the at least one hydraulic drive plunger (16, 17) and the other side of which is connected to an expansion element (41, 42) storing kinetic energy in the form of pressure when the carriage is pushed in its forward stroke and giving the kinetic energy back for pushing the carriage (20, 21) when in its backward stroke. In particular, the at least one drive plunger (16, 17) are two in number and are disposed in phase opposition to be controlled by the cam (11) for alternately pushing two carriages (20, 21) aligned with each other along a forward stroke.

10 Claims, 1 Drawing Sheet

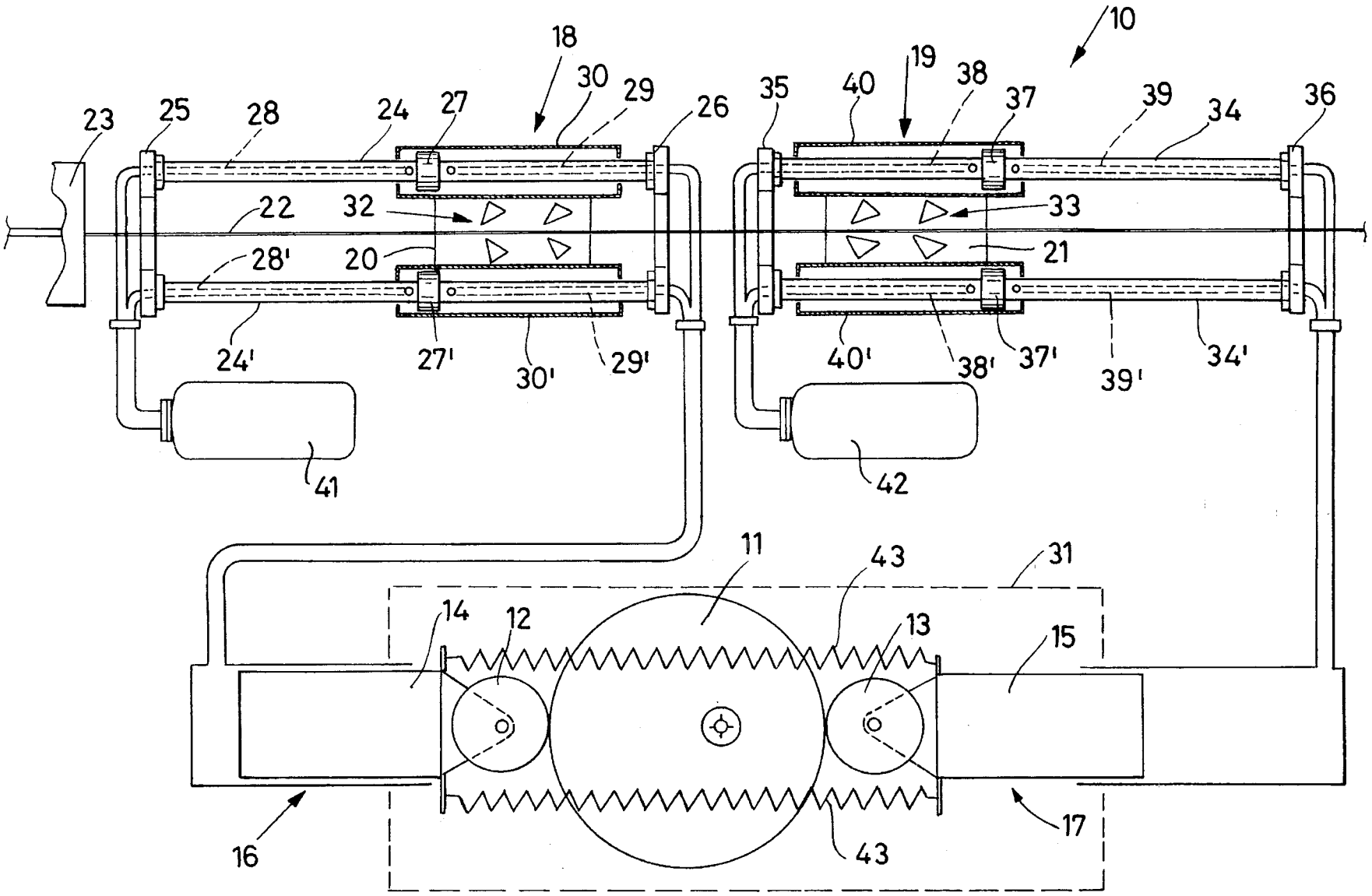
10
11
12
13
14
15
16
17
18
19
20
21
22
23
24
24'
25
26
27
27'
28
28'
29
29'
30
30'
31
32
33
34
34'
35
36
37
37'
38
38'
39
39'
40
40'
41
42
43
43

CAM ACTIVATED HYDRAULIC DRIVE WITH HYDRO-PNEUMATIC ACCUMULATOR

BACKGROUND OF THE INVENTION

The present invention relates to an innovative drive unit for traction carriages, such as for drawbenches.

Generally, traction carriages are two in number and are alternately moved in a to-and-fro synchronized movement by mechanical drive units.

Drive units are known which are provided with axial cams in head-on contact with pusher rollers integral with the carriages. These cams must bear important efforts and are therefore very expensive due to their manufacture complexity and at all events they have a restricted duration of life because it is impossible to make them with appropriate surface hardness, owing to the substantial impossibility of lubricating them and to the movement dynamics generating a continuous sliding between races and rollers, since the relative peripheral speeds are forcedly different.

A further disadvantage of this solution is that the entire structure is under great stress, due to the tilting torques from the arm existing between the thrust axis of the rollers on the carriages and the traction axis of the carriages, and to the transverse components arising from the angle of inclination of the cam.

In addition, in order to increase the work speed while keeping the forces of inertia generated by the reciprocating motion of the carriages to acceptable values, the only solution consists in increasing the carriage stroke. With the above mechanical operation such a result can be achieved only if the cam diameter and/or the inclination of the cam races is increased, which however brings about an augmentation of all problems relating to costs and wear and also further problems due to an excessive bulkiness.

In order to obviate all problems present when axial cams are adopted, a drive unit has been proposed, as described in EP 0 255 740 for example, in which two radial cams are employed.

Resting on said radial cams are roller followers that are each operated by a rack engaging with a gear axially integral with a pinion, in turn engaging with a further rack integral with the carriage. In this manner, a ratio multiplying the cam stroke is achieved. This solution eliminates some of the problems connected with the use of axial cams, but on the other hand it is expensive and, due to clear mechanical and dimensional reasons, it does not allow the carriage stroke to be increased in a substantial manner.

The general object of the present invention is to obviate the above mentioned drawbacks by providing a drive unit for traction carriages enabling the carriages to carry out a stroke of large width without taking too much place, while ensuring the absence of elements submitted to excessive wear, and at the same time reduce costs and the elimination of complicate manufacture workings.

SUMMMARY OF THE INVENTION

In view of the above object, in accordance with the invention a drive unit for traction carriages, in particular for drawbenches, has been devised which comprises a cam acting on at least one hydraulic drive plunger, the drive plunger being hydraulically connected to at least one thrust plunger of a traction carriage along the stroke thereof.

Advantageously, the thrust plunger is a double-acting plunger one side of which is connected to said hydraulic drive plunger and the other side is connected to an expansion element storing kinetic energy in the form of pressure, when said thrust plunger pushes the carriage in its forward stroke, and then giving back the stored energy when it pushes the carriage in its backward stroke.

BRIEF DESCRIPTION OF THE DRAWING

For better explaining the innovative principles of the present invention and the advantages it offers over the known art, a possible embodiment of the invention applying said innovatory principles will be given hereinafter with the aid of the accompanying drawing.

DETAILED DESCRIPTION OF THE INVENTION

With reference to the FIGURE, a drive unit generally denoted by 10, comprises a radial cam 11 acting on drive plungers for controlling the thrust plungers of traction carriages. In particular, the cam 11 pushes on an opposite pair of roller followers 12, 33, each supported by a movable piston 14, 15 of a corresponding hydraulic drive plunger 16, 17 radial to the cam. Advantageously, the cam and followers 12, 13 can be dipped in an oil bath, diagrammatically shown in chain line at 31, for lubrication and cooling, if necessary, through known heat exchangers, easily imaginable by a person skilled in the art and not shown.

Each drive plunger 16, 17 is connected to one side of a pair of double-acting hydraulic driven plungers 18, 19. Each pair of driven plungers 18, 19 is connected for movement of a corresponding traction carriage 20, 21. Carriages are disposed in alignment with each other so as to slide in a rectilinear direction between two limit positions, and carry known drawing grippers 32, 33 for a substantially thread-like element 22, for pulling it through a drawing machine 23, for example. Grippers are not further described or shown as they can be easily imagined by a person skilled in the art.

The other side of the driven plungers of each pair is connected to a corresponding known hydropneumatic expansion element 41, 42 embodying a hydraulic spring.

As clearly shown in the drawing, the cam is structured in such a manner that it drives the plungers in opposition to each other so that the carriages as well are always in opposition, which means that when one of them is at one limit end of its stroke the other is at the opposite limit end. In this manner, when one carriage carries out its traction stroke, the other carriage carries out its return stroke and vice versa, thereby furnishing the desired uninterrupted drawing action.

For simplicity purposes, the cam has been shown as having an eccentric circular shape. It is however obvious that the exact cam profile may be more complicated in order to enable the carrages to move according to a movement having predetermined accelerations and speeds at each point of the travel path.

For example, it is possible to envisage a cam profile of such a shape that the carriage arrival at the two stroke ends should occur at a substantially zero speed so as to reduce the forces of inertia of the reciprocating masses. Such cam profiles may be easily contemplated by a person skilled in the art.

Advantageously, the driven plungers are made with rods fixed at the ends to constitute slide guides for the carriages. Each rod carries at an intermediate position the piston on which the driven plunger casing is freely movable. The rod has inner passages starting from the end of each rod and going close to the piston, so as to accomplish a double-acting plunger connected on one side to the corresponding drive plunger and on the other side to the corresponding hydraulic spring.

As a result, the driven plunger pair 18 has rods 24, 24' disposed parallel between fixed supports 25, 26 and carrying pistons 27, 27'. A passage 28 or 28' opens onto one side of each piston 27 or 27', which passage is connected through the rod to the hydraulic spring 41, whereas opening onto the opposite side of the piston 27 or 27' is a passage 29, or 29' connected, through the rod as well, to the drive plunger 16.

Slidable on the rods 24 or 24' are corresponding casings 30, 30' integral with the carriage 20.

Likewise, the driven plunger pair 19 has rods 34, 34' disposed parallel between fixed supports 35, 36 and carrying pistons 37, 37'. A passage 38 or 38' opens onto one side of each piston 37 or 37' and it is connected through the rod to the hydraulic spring 42, whereas opening onto the opposite side of the piston 37 or 37' is a passage 39 or 39' connected, still through the rod, to the drive plunger 17. Corresponding casings 40, 40' integral with the carriage 21 slide on the rods 34 or 34'. All rods are advantageously disposed symmetrical to the sides and in a drawing plane of the carriages, that is in a slide plane of the thread-like element 22, so that the hydraulic thrust received by the traction carriages is coaxial with the guides thereof and perfectly aligned with the drawing resistance. Thus, the tilting torque and side thrusts are eliminated, as well as any other components originating from a thrust or resistance.

In operation, the cam rotation produces a thrust on one of the drive plungers 16 or 17 which, through the hydraulic connection, is transmitted to the corresponding pair of plungers for moving a traction carriage. The traction carriage moves along its forward or traction stroke with the grippers holding fast the thread-like element. During its forward movement the oil present on the opposide side of the piston is pushed into the corresponding expansion element where kinetic energy is thus stored in the form of pressure, which energy is then given back in the acceleration step during the return stroke that will occur when the cam enables the drive plunger to expand again.

The achieved result is that, while the carriage is performing its forward stroke being pushed by the drive plunger, the other carriage with the grippers disengaged from the thread-like element, performs its return stroke in perfect synchronism therewith, being pushed by said pressure stored in the expansion element.

Thus by the continuous cam rotation the desired reciprocating movement typical of drawbenches is achieved. The existence of the hydropneumatic circuit embodied by the expansion elements 41, 42 makes the followers never separate from the cam so that shocks and slidings are prevented, which is advantageous for increasing the duration of life and reducing noise in running.

Should it be deemed necessary, springs 43 may be placed between the two movable pistons 14, 15, which will help the hydropneumatic circuit.

At this point it is apparent that by providing a hydraulic drive device in place of traditional mechanical drive devices the intended objects are achieved.

The carriage stroke has no limits imposed by mechanics and said stroke can be established beforehand during the planning step, by merely modifying the volume ratios between the drive cylinders and driven cylinders.

Therefore the appropriate stroke for the required work speed can be always set.

The radial cam is not subjected to slidings and can work over the whole contact band and on rollers of big diameter and therefore with low specific pressure. The above, together with the possibility of working in an oil bath, ensures the cam and the rollers a very long lifetime without servicing and mechanical restoration adjustments being necessary.

As there are no mechanical links for the relative arrangements between the carriages and cam, the thrust received by the traction carriages can be coaxial with the guides and perfectly aligned with the drawing resistance. Since the tilting torque and side thrusts are eliminated, as well as any other components originating from a thrust or resistance, guides and carriages are relieved of any wear source, wear being also prevented due to the fact that sliding takes place in an oil bath.

In addition, the absence of mechanical connections between the carriage bench and cam enables the machine to be planned with a minimum bulkiness depending on the particular practical requirements.

The forces of inertia of the masses provided with reciprocating motion, which are reduced due to the possibility of carrying out wide strokes, are on the other hand controlled in real time by the hydropneumatic feedback system.

Obviusly, the above description of an embodiment applying the innovatory principles of the invention is given by way of example only and therefore cannot be considered as a limitation of the scope of the invention as herein claimed.

For example, the hydraulic circuits can comprise expansion tanks, pumps, safety valves and all other known elements of common use in these types of installations.

As known to a person skilled in the art, it is also possible to provide supercharging of the two hydraulic (forward and backward) circuits in order to prevent possible cavitation phenomena and/or emulsifying of the hydraulic fluid.

In addition, there may also be one expansion element for each thrust cylinder.

What is claimed is:

1. A drive unit for traction carriages, for drawbenches, comprising a cam, at least one hydraulic drive plunger, at least one thrust plunger and a first traction carriage, said cam acting on said at least one hydraulic drive plunger, said hydraulic drive plunger being hydraulically connected to said at least one thrust plunger for moving said first traction carriage along its stroke and a thrust plunger casing, said thrust plunger comprising a partially hollow rod fastened at both ends to two fixed supports and carrying at an intermediate non hollow position a piston on which the plunger casing is movable, said casing being integral with the carriage.

2. The drive unit according to claim 1, said rod having a first inner passage disposed between one end of said rod and a first end of said piston and a second inner passage disposed between another end of said rod and a second end of said piston, said first and second passages being hydraulically connected to said expansion element and said at least one drive plunger, respectively.

3. A drive unit for traction carriages, for drawbenches, comprising a cam, first and second hydraulic drive plungers, first and second thrust plungers and first and second traction carriages, said cam acting on both of said hydraulic drive plungers, each said hydraulic drive plunger being hydraulically connected to one of said thrust plungers for moving one of said first and second traction carriages along its forward stroke, said first and second drive plungers being disposed in phase opposition to each other and both being driven by said cam to continuously but alternately hydraulically push said two carriages aligned with each other along forward strokes.

4. The drive unit according to claim 3, including a further thrust plunger so that there are at least two in number for said carriage, said thrust plungers being disposed symmetrically laterally of the carriage and in the same plane.

5. The drive unit according to claim 3, wherein said cam is radial and including two cam followers each rotatably engaged to said cam and one of said first and second drive plungers, said cam followers and drive plungers being disposed on opposite sides of said cam for carrying out said phase-opposition driving action.

6. The drive unit according to claim 3, including an oil bath into which the cam is disposed.

7. A drive unit for traction carriages, for drawbenches, comprising a cam, at least one hydraulic drive plunger, at least one thrust plunger, a first traction carriage, said cam acting on said at least one hydraulic drive plunger, said hydraulic drive plunger being hydraulically connected to said at least one thrust plunger for moving said first traction carriage along its stroke and an expansion element, wherein said at least one thrust plunger is a double-acting plunger, one side of which is hydraulically connected to said at least one hydraulic drive plunger and the other side of which is hydraulically connected to said expansion element for storing kinetic energy in the form of pressure when the carriage is moved in a forward stroke, and then giving back the stored energy for biasing the carriage in a backward stroke.

8. The drive unit according to claim 7, including a rod, a piston externally fixed to said rod and cylinder slidable on said piston rod having said first inner passage disposed between one end of said rod and a first end of said piston and a second inner passage disposed between an other end of said rod and a second end of said piston, said first and second passages being hydraulically connected to said expansion element and said at least one drive plunger, respectively.

9. The drive unit according to claim 7, wherein said expansion element is a hydropneumatic expansion element.

10. A drive unit for traction carriages, for drawbenches, comprising a cam, first and second hydraulic drive plungers, at least one thrust plunger and a first traction carriage, said cam acting on at least one of said first and second hydraulic drive plungers, one of said first and second hydraulic drive plungers being hydraulically connected to said at least one thrust plunger for moving said first traction carriage along its stroke and traction springs, said traction springs being placed between said first and second drive plungers.

* * * * *